US010629128B2

(12) United States Patent
Yang et al.

(10) Patent No.: US 10,629,128 B2
(45) Date of Patent: Apr. 21, 2020

(54) DISPLAY DEVICE USING A SIMULTANEOUS EMISSION DRIVING METHOD AND PIXEL INCLUDED IN THE DISPLAY DEVICE

(71) Applicant: SAMSUNG DISPLAY CO., LTD., Yongin-si, Gyeonggi-do (KR)

(72) Inventors: Taehoon Yang, Yongin-si (KR); Dae-Hyun Noh, Yongin-si (KR); Yongsung Park, Yongin-si (KR); Minwoo Byun, Yongin-si (KR)

(73) Assignee: SAMSUNG DISPLAY CO., LTD., Yongin-si, Gyeonggi-do (KR)

( * ) Notice: Subject to any disclaimer, the term of this patent is extended or adjusted under 35 U.S.C. 154(b) by 0 days.

(21) Appl. No.: 16/121,083

(22) Filed: Sep. 4, 2018

(65) Prior Publication Data

US 2019/0073957 A1 Mar. 7, 2019

(30) Foreign Application Priority Data

Sep. 5, 2017 (KR) ..... 10-2017-0113537

(51) Int. Cl.
*G09G 3/3258* (2016.01)
*G09G 3/3233* (2016.01)
(Continued)

(52) U.S. Cl.
CPC ..... *G09G 3/3258* (2013.01); *G09G 3/3233* (2013.01); *G09G 3/3266* (2013.01);
(Continued)

(58) Field of Classification Search
CPC .. G09G 3/3258; G09G 3/3266; G09G 3/3275; G09G 2300/0819; G09G 2310/0205; G09G 2330/021
See application file for complete search history.

(56) References Cited

U.S. PATENT DOCUMENTS 7,675,343 B2 3/2010 Kwon
9,401,111 B2 * 7/2016 Kishi ..... G09G 3/3233
(Continued)

FOREIGN PATENT DOCUMENTS

KR 10-2012-0075040 A 7/2012
KR 10-2016-0017871 A 2/2016
(Continued)

*Primary Examiner* — Lixi C Simpson
(74) *Attorney, Agent, or Firm* — Kile Park Reed & Houtteman PLLC

(57) ABSTRACT

A display device includes a display panel including a plurality of pixels, and a panel driver that generates a scan signal, a global signal, and data signals, and provides first and second power supply voltages to the display panel. Each pixel includes a first transistor between one of data line and a first node, the first transistor receiving the scan signal at a gate of the first transistor, a second transistor to transfer the first power supply voltage in response to the global signal, a driving transistor between the second transistor and a second node, the driving transistor having a gate connected to the first node, an organic light emitting diode between the second node and the second power supply voltage, and a storage capacitor between the first node and the second node. The driving transistor and the second transistor are different ones of P-type and N-type transistors.

19 Claims, 8 Drawing Sheets

(51) Int. Cl.
*G09G 3/3275* (2016.01)
*G09G 3/3266* (2016.01)

(52) U.S. Cl.
CPC ... *G09G 3/3275* (2013.01); *G09G 2300/0819* (2013.01); *G09G 2300/0842* (2013.01); *G09G 2300/0861* (2013.01); *G09G 2310/0262* (2013.01); *G09G 2320/045* (2013.01)

(56) References Cited

U.S. PATENT DOCUMENTS

| | | | | |
|---|---|---|---|---|
| 2016/0240565 | A1* | 8/2016 | Kim | H01L 27/1251 |
| 2018/0190194 | A1* | 7/2018 | Zhu | H01L 27/12 |
| 2018/0277037 | A1* | 9/2018 | Lin | G09G 3/3233 |
| 2019/0006452 | A1* | 1/2019 | Cho | G09G 3/3258 |

FOREIGN PATENT DOCUMENTS

| | | | |
|---|---|---|---|
| KR | 10-2016-0067636 | A | 6/2016 |
| KR | 10-1674153 | B1 | 11/2016 |
| KR | 10-2017-0012583 | A | 2/2017 |

* cited by examiner

DISPLAY DEVICE USING A SIMULTANEOUS EMISSION DRIVING METHOD AND PIXEL INCLUDED IN THE DISPLAY DEVICE

CROSS-REFERENCE TO RELATED APPLICATION

Korean Patent Application No. 10-2017-0113537, filed on Sep. 5, 2017, in the Korean Intellectual Property Office, and entitled: "Display Device Using A Simultaneous Emission Driving Method and Pixel Included in the Display Device," is incorporated by reference herein in its entirety.

BACKGROUND

1. Field

Exemplary embodiments relate to display devices and, more particularly, to display devices using a simultaneous emission driving method and pixels included in the display devices.

2. Description of the Related Art

To display an image, a display device may use a sequential emission driving method that drives pixels to sequentially emit light on a row-by-by basis, or may use a simultaneous emission driving method that drives all pixels to simultaneously emit light. Further, in a display device such as an organic light emitting diode (OLED) display device, driving transistors included in respective pixels may have different threshold voltages due to a process variation, etc. To compensate for this threshold voltage deviation, various circuit structures for the pixel in the display device have been researched and developed. However, the pixel may have a complicated circuit structure to compensate for the threshold voltage deviation and to be driven in the simultaneous emission driving method. Further, if the pixel has a complicated circuit structure, it may be difficult to implement a high-resolution display device.

SUMMARY

According to example embodiments, there is provided a display device including a display panel including a plurality of scan lines, a plurality of data lines, a common emission control line, and a plurality of pixels connected to the scan lines, the data lines and the common emission control line, and a panel driver to generate a scan signal sequentially provided to the scan lines, to generate data signals provided to the data lines, to generate a global signal provided to the common emission control line, and to provide a first power supply voltage and a second power supply voltage to the display panel. Each of the plurality of pixels includes a first transistor connected between one of the data lines and a first node, the first transistor receiving the scan signal at a gate of the first transistor, a second transistor configured to transfer the first power supply voltage in response to the global signal, the first power supply voltage having a first voltage level or a second voltage level higher than the first voltage level, a driving transistor connected between the second transistor and a second node, the driving transistor having a gate connected to the first node, an organic light emitting diode connected between the second node and a line of the second power supply voltage, the second power supply voltage having a voltage level higher than the first voltage level and lower than the second voltage level, and a storage capacitor connected between the first node and the second node. The driving transistor is one of N-type or P-type transistor and the second transistor is another of N-type or P-type transistor.

In example embodiments, the driving transistor may be an N-type metal oxide semiconductor (MOS) transistor, and the second transistor may be a P-type MOS transistor.

In example embodiments, each frame of the display device may include an initialization period in which a voltage of the first node and a voltage of the second node are initialized, a compensation period in which a threshold voltage of the driving transistor is compensated, a writing period in which the data signals are sequentially written to the pixels on a row-by-row basis, and a simultaneous emission period in which all the pixels simultaneously emit light based on the data signals.

In example embodiments, the panel driver may invert, at every predetermined number of frames, an order of outputting the scan signal in the writing period.

In example embodiments, the panel driver may sequentially provide the scan signal in a first order from a first scan line to a last scan line in the writing period of a first frame, and may sequentially provide the scan signal in a second order opposite to the first order from the last scan line to the first scan line in the writing period of a second frame.

In example embodiments, in the initialization period, the first power supply voltage may have the first voltage level, and the scan signal and the global signal may have a turn-on level.

In example embodiments, in the compensation period, the first power supply voltage may have the second voltage level, and the scan signal and the global signal may have a turn-on level.

In example embodiments, in the writing period, the first power supply voltage may have the first voltage level, the scan signal may have a turn-on level, and the global signal may have a turn-off level.

In example embodiments, in the simultaneous emission period, the first power supply voltage may have the second voltage level, the scan signal may have a turn-off level, and the global signal may have a turn-on level.

In example embodiments, the panel driver may provide a predetermined reference voltage to the data lines in the initialization period and the compensation period.

In example embodiments, the first transistor may be a P-type MOS transistor.

In example embodiments, the first transistor may be an N-type MOS transistor.

In example embodiments, a turn-on level of the scan signal may be a high voltage level, and a turn-on level of the global signal may be a low voltage level.

In example embodiments, a swing width of the global signal may be less than a swing width of the scan signal.

In example embodiments, a high voltage level of the global signal may be lower than the high voltage level of the scan signal.

In example embodiments, each of an initialization operation in the initialization period and a compensation operation in the compensation period may be performed simultaneously to all the pixels.

According to example embodiments, there is provided a pixel including a first transistor connected between a data line and a first node, the first transistor receiving a scan signal at a gate of the first transistor, a second transistor configured to transfer a first power supply voltage in response to a global signal, the first power supply voltage having a first voltage level or a second voltage level higher than the first voltage level, a driving transistor connected between the second transistor and a second node, the driving transistor having a gate connected to the first node, an organic light emitting diode connected between the second node and a line of a second power supply voltage, the second power supply voltage having a voltage level higher than the first voltage level and lower than the second voltage level, and a storage capacitor connected between the first node and the second node. The driving transistor has one of N-type or P-type, and the second transistor has the other of N-type or P-type.

In example embodiments, the driving transistor may be an N-type metal oxide semiconductor (MOS) transistor, and the first transistor and the second transistor may be P-type MOS transistors.

In example embodiments, the driving transistor may be implemented with one of an oxide thin film transistor (TFT), a low temperature poly-silicon (LTPS) TFT and a low temperature polycrystalline oxide (LTPO) TFT.

In example embodiments, the driving transistor and the first transistor may be N-type MOS transistors, and the second transistor may be a P-type MOS transistor.

BRIEF DESCRIPTION OF THE DRAWINGS

Features will become apparent to those of skill in the art by describing in detail exemplary embodiments with reference to the attached drawings in which.

DETAILED DESCRIPTION

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

Figure 1:
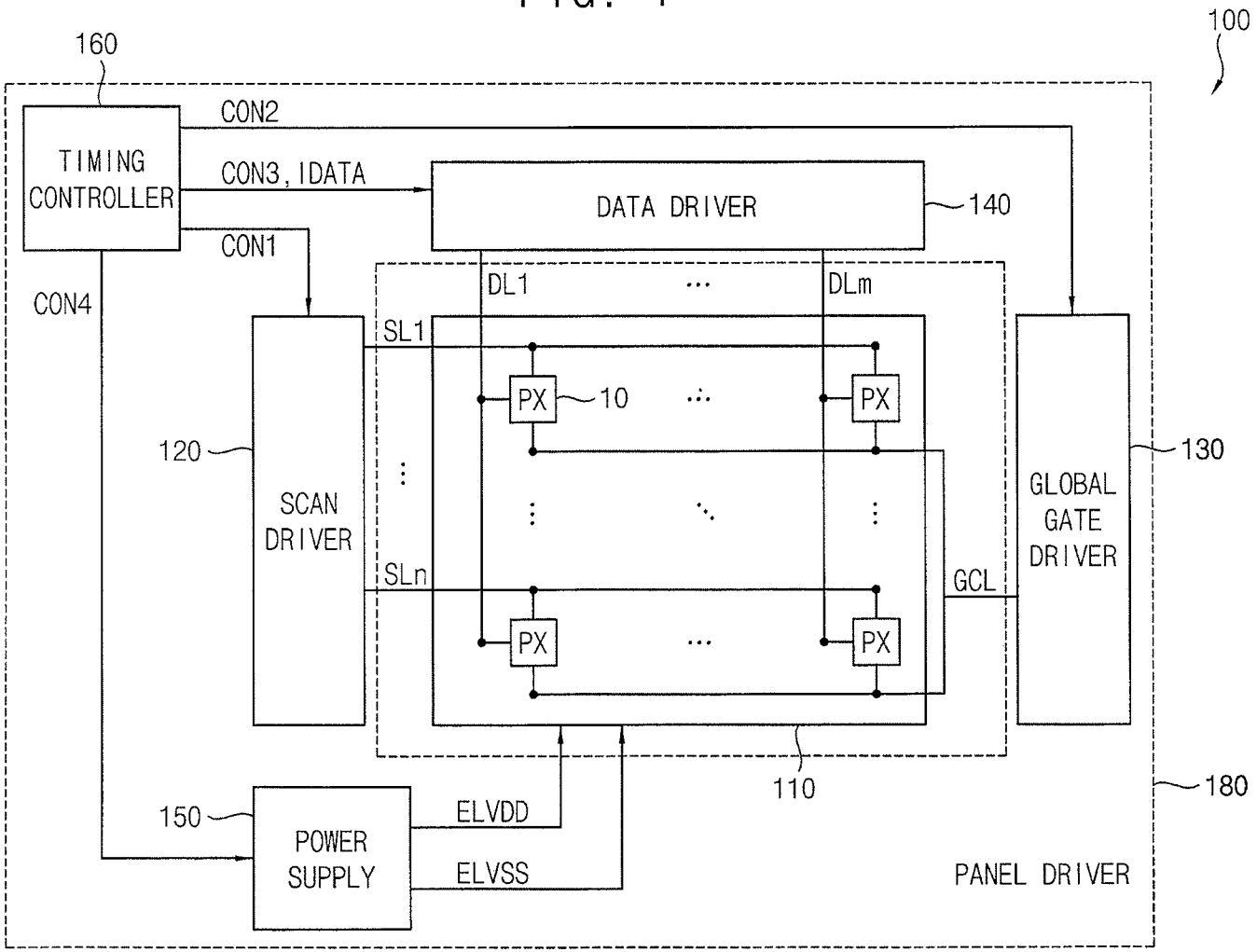
FIG. 1 illustrates a block diagram of a display device according to example embodiments.

FIG. 1 is a block diagram illustrating a display device according to example embodiments.

Referring to FIG. 1, a display device 100 includes a display panel 110 and a panel driver 180 that includes drivers 120, 130, 140, power supply 150, and timing controller 160 that drives the display panel 110.

The display device 100 may display an image in a sequential writing (or sequential scan) and simultaneous emission driving method. The display device 100 may be implemented as an organic light emitting diode (OLED) display device. In some example embodiments, the display device 100 may be a flat panel display device, a flexible display device, a transparent display device, a head mounted display (HMD) device, or the like. The panel driver 180 may drive the display panel 110 in the simultaneous emission driving method, and each frame may include a simultaneous emission period in which all pixels 10 simultaneously emit light.

The display panel 110 may include a plurality of scan lines SL1 through SLn, a plurality of data lines DL1 through DLm, and a plurality of pixels 10 respectively connected to the plurality of scan lines SL1 through SLn and the plurality of data lines DL1 through DLm. The display panel 110 may further include a common emission control line GCL, and the plurality of pixels 10 may be commonly connected to the common emission control line GCL.

Each pixel 10 may include a first transistor connected between one of the data lines DL1 through DLm and a first node and receiving a scan signal at a gate of the first transistor, a second transistor that transfers a first power supply voltage ELVDD having a first voltage level or a second voltage level higher than the first voltage level in response to a global signal, a driving transistor connected between the second transistor and a second node and having a gate connected to the first node, an organic light emitting diode connected between the second node and a line of a second power supply voltage ELVSS having a voltage level higher than the first voltage level and lower than the second voltage level, and a storage capacitor connected between the first node and the second node. A configuration and an operation of the pixel 100 will be described below with reference to FIGS. 2 through 7.

The panel driver 180 may generate the scan signal sequentially provided to the scan lines SL1 through SLn, may generate data signals provided to the data lines DL1 through DLm, may generate the global signal provided to the common emission control line GCL, and may provide the first power supply voltage ELVDD and the second power supply voltage ELVSS to the display panel 110. In some example embodiments, the panel driver 180 may include a scan driver 120 to generate the scan signal, a global gate driver 130 to generate the global signal, a data driver 140 to generate the data signals, a power supply 150 to generate the power supply voltages, and a timing controller 160 to control operations of the drivers 120, 130, 140 and the power supply 150.

The scan driver 120 may provide the scan signal to the scan lines SL1 through SLn based on a first control signal CON1. In some example embodiments, the scan driver 120 may apply the scan signal (or the scan signal having a turn-on level) simultaneously all the pixels 10, or may sequentially apply the scan signal to the display panel 110 on a row-by-row basis.

The global gate driver 130 may provide the global signal to the common emission control line GCL based on a second control signal CON2. The global signal may simultaneously control the light-emission of all the pixels 10. For example, a voltage level of the global signal may control an electrical connection between a line of the first power supply voltage ELVDD and the driving transistor included in the pixel 10. In some example embodiments, the global gate driver 130 may be spaced apart from the scan driver 120. In other example embodiments, the global gate driver 130 may be included in the scan driver 120.

The data driver 140 may generate the data signals (or data voltages) based on a third control signal CON3 and image data IDATA. For example, the data driver 140 may convert the digital image data IDATA into the analog data signals, and may provide the data signals to the pixels through the first through m-th data lines DLI through DLm.

The power supply 150 may provide the first power supply voltage ELVDD and the second power supply voltage ELVSS to the display panel 110. For example, the power supply 150 may include a DC-DC converter that generates output voltages having various voltage levels based on an input voltage (e.g., a battery voltage). The DC-DC converter may output as the output voltages the first power supply voltage ELVDD and the second power supply voltage ELVSS having desired voltage levels based on a fourth control signal CON4. In some example embodiments, the first power supply voltage ELVDD may swing between the first voltage level and the second voltage level higher than the first voltage level, the second power supply voltage ELVSS may have a constant voltage level, e.g., a third voltage level, higher than the first voltage level and lower than the second voltage level. For example, the second power supply voltage ELVSS may be a ground voltage, the first voltage level of the first power supply voltage ELVDD may be a negative voltage level, and the second voltage level of the first power supply voltage ELVDD may be a positive voltage level. Thus, the power supply 150 may change the first power supply voltage ELVDD between the negative voltage level and the positive voltage level in the simultaneous emission driving method.

The timing controller 160 may control operations of the scan driver 120, the global gate driver 130, the data driver 140, and the power supply 150. The timing controller 160 may provide the first through fourth control signals CON1, CON2, CON3 and CON4 to the scan driver 120, the global gate driver 130, the data driver 140 and the power supply 150 to control the operations of the scan driver 120, the global gate driver 130, the data driver 140 and the power supply 150. In some example embodiments, the timing controller 160 may receive an RGB image signal, a vertical synchronization signal, a horizontal synchronization signal, a main clock signal, a data enable signal, etc. from an external graphic controller, and may generate the first through fourth control signals CON1, CON2, CON3 and CON4 and the image data IDATA based on these signals.

As described above, the display device 100 may be driven in the simultaneous emission driving method, and may include the pixel 10 having a simple circuit structure.

Figure 2:
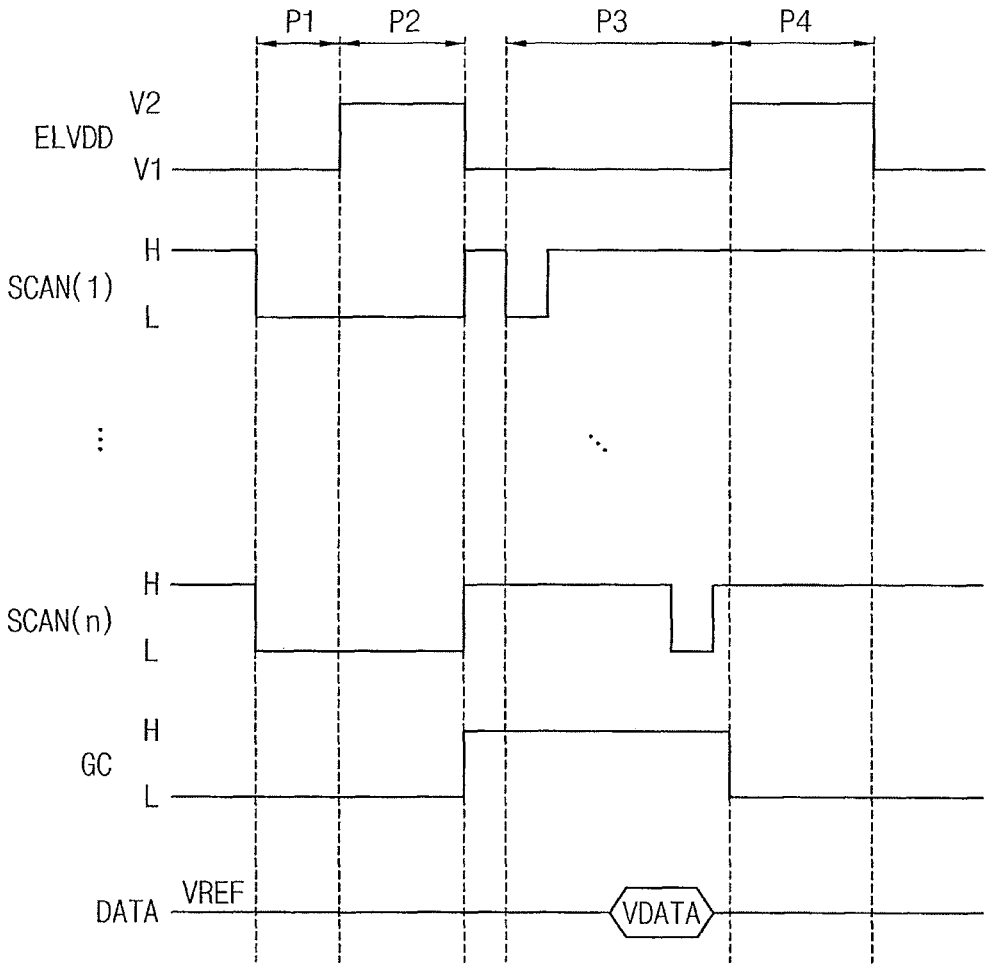
FIG. 2 illustrates a timing diagram for describing an example of an operation of a display device of FIG. 1.

FIG. 2 is a timing diagram for describing an example of an operation of a display device of FIG. 1. Referring to FIGS. 1 and 2, each frame of a display device 100 may include an initialization period P1, a compensation period P2 after the initialization period P1, a writing period P3 after the compensation period P2, and a simultaneous emission period P4 after the writing period P3.

In this embodiment, the switching transistors (e.g., first and second transistors T1 and T2 in FIG. 3) are P-type (or P-channel) metal oxide semiconductor (MOS) transistors. That is, a turn-on level L of a scan signal SCAN(1) through SCAN(n) and a global signal GC may be a low voltage level L, and a turn-off level H of the scan signal SCAN(1) through SCAN(n) and the global signal GC may be a high voltage level H. Alternatively, in an embodiment where a switching transistor (e.g., a first transistor T1 or a second transistor T2 in FIG. 3) is an N-type (or N-channel) MOS transistor, a turn-on level of a signal for turning on the switching transistor may be a high voltage level, and a turn-off level of a signal for turning off the switching transistor may be a low voltage level.

In the initialization period P1, a first power supply voltage ELVDD may have a first voltage level V1, and first through n-th scan signals SCAN(1) through SCAN(n) and the global signal GC may have the turn-on level L. Accordingly, an initialization operation for all pixels 10 may be performed, and thus a gate voltage of a driving transistor and an anode voltage of an OLED may be initialized to predetermined voltage levels. That is, the initialization operation in the initialization period P1 may be simultaneously performed for all the pixels 10.

In the compensation period P2, the first power supply voltage ELVDD may be changed from the first voltage level V1 to the second voltage level V2, and the first through n-th scan signals SCAN(1) through SCAN(n) and the global signal GC may maintain the turn-on level L. Accordingly, in the compensation period P2, a threshold voltage compensation operation may be performed for all the pixels 10, and thus a threshold voltage of the driving transistor may be compensated. That is, the threshold voltage compensation operation in the compensation period P2 may be simultaneously performed for all the pixels 10. In some example embodiments, the first voltage level V1 of the first power supply voltage ELVDD may be about −2.2 V, and the second voltage level V2 of the first power supply voltage ELVDD may be about 7 V.

In the writing period P3, the first power supply voltage ELVDD may again have the first voltage level V1, the global signal GC may have the turn-off level H, and the first through n-th scan signals SCAN(1) through SCAN(n) may sequentially have the turn-on level L. Accordingly, in the writing period P3, data signals may be sequentially written on a row-by-row basis. For example, as illustrated in FIG. 2, a data writing operation may be sequentially performed in an order from a first row of pixels 10 to which the first scan signal SCAN(1) is applied to an n-th row of pixels 10 to which the n-th scan signal SCAN(n).

In the simultaneous emission period P4, the first power supply voltage ELVDD may be again changed from the first voltage level V1 to the second voltage level V2, the first through n-th scan signals SCAN(1) through SCAN(n) may have the turn-off level H, and the global signal GC may have the turn-on level L. Accordingly, the pixels 10 may simultaneously emit light with luminance corresponding to the applied data signals.

As described above, in each frame, the display device 100 may sequentially write the data signals to the pixels 10 on a row-by-row basis, and may allow all the pixels 10 to simultaneously emit light.

Figure 3:
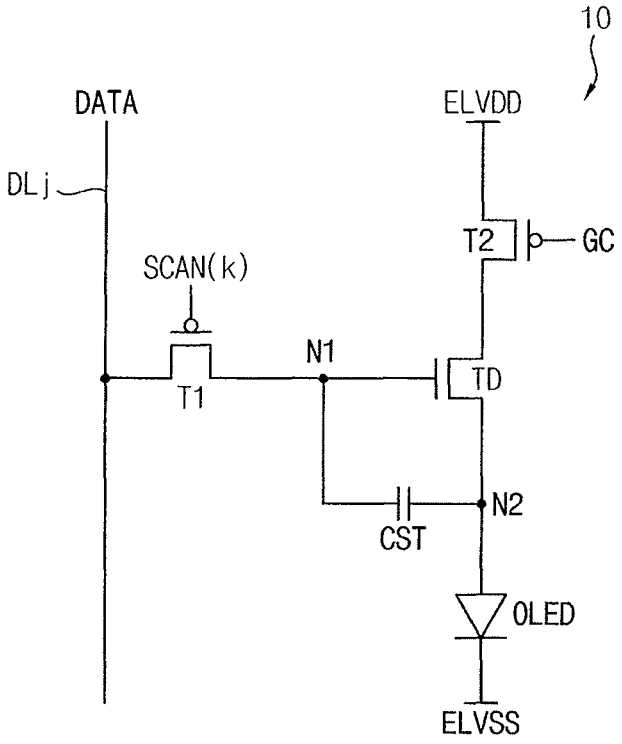
FIG. 3 illustrates a circuit diagram of a pixel included in a display device of FIG. 1 according to example embodiments.

FIG. 3 is a circuit diagram illustrating a pixel included in a display device of FIG. 1 according to example embodiments. Referring to FIG. 3, a pixel 10 may include a first transistor T1, a second transistor T2, a driving transistor TD, an organic light emitting diode OLED, and a storage capacitor CST.

In some example embodiments, the driving transistor TD may be an N-type (or N-channel) MOS transistor, and the first and second transistors T1 and T2 may be P-type (or P-channel) MOS transistors. The first and second transistors T1 and T2 may operate as switching transistors.

The first transistor T1 may be connected between a data line DLj and a first node N1. For example, the first transistor T1 may include a first terminal connected to the data line DLj and a second terminal connected to the first node N1. A gate of the first transistor T1 may receive a scan signal SCAN(k). The first transistor T1 may transfer a data signal DATA to the first node N1 (i.e., the storage capacitor CST or a gate of the driving transistor TD). In some example embodiments, the data signal DATA may include a reference voltage for initialization and a data voltage for light emission.

The second transistor T2 may be connected between a line of a first power supply voltage ELVDD and the driving transistor TD. For example, the second transistor T2 may include a first terminal connected to the line of the first power supply voltage ELVDD, and a second terminal connected to the driving transistor TD. A gate of the second transistor T2 may receive a global signal GC. The second transistor T2 may connect the line of the first power supply voltage ELVDD to the driving transistor TD in response to global signal GC, and may transfer the first power supply voltage ELVDD to a first terminal of the driving transistor TD. The first power supply voltage ELVDD may have a first voltage level lower than a voltage level of a second power supply voltage ELVSS or a second voltage level higher than the voltage level of the second power supply voltage ELVSS.

In some example embodiments, each of the first and second transistors may be a low temperature poly-silicon (LTPS) thin film transistor (TFT), a low temperature poly-crystalline oxide (LTPO) TFT, or the like. However, the first and second transistors may not be limited to the LTPS TFT or the LTPO TFT, and may be any N-type transistors.

The first terminal of the second transistor T2 may be directly connected to the line of the first power supply voltage ELVDD that may be a high power supply voltage. Thus, when the second transistor T2 is an N-type MOS transistor, a turn-on level of the global signal GC applied to the gate of the second transistor T2 may be sufficiently higher than the second voltage level of the first power supply voltage ELVDD to fully turn on the second transistor T2. In this case, the global signal GC may have a large swing width. For example, if the first power supply voltage ELVDD swings between about 7 V and −2.2 V, the turn-on level (or a high voltage level) and the turn-off level (or a low voltage level) of the global signal GC may be set to 17 V and −7 V, respectively. Thus, the swing width of the global signal GC may be about 24 V.

However, when the second transistor T2 is the P-type MOS transistor as illustrated in FIG. 3, the second transistor T2 may be turned on when the global signal GC has a low voltage level. For example, if the first power supply voltage ELVDD swings between about 7 V and −2.2 V, the turn-on level (or a low voltage level) and the turn-off level (or a high voltage level) of the global signal GC may be set to −7 V and 9 V to fully turn on and off the second transistor T2, respectively. Thus, the swing width of the global signal GC may be about 16 V. That is, in the pixel 10 including the N-type MOS driving transistor TD and driven in a simultaneous emission driving method, when the second transistor T2 is the P-type MOS transistor, the swing width of the global signal GC may be decreased by more than about 30% compared with the second transistor T2 being the N-type MOS transistor. Accordingly, power consumption for outputting the global signal GC may be reduced. Similarly, when the first transistor T1 is implemented with the P-type MOS transistor, the swing width of the scan signal SCAN(k) may be decreased by more than about 30%, and thus power consumption for outputting the scan signal SCAN(k) may be reduced.

The driving transistor TD may be connected between the second transistor T2 and a second node N2. For example, the driving transistor TD may include a first terminal connected to the second terminal of the second transistor T2 and a second terminal connected to the second node N2. A gate of the driving transistor TD may be connected to the first node N1. The driving transistor TD may generate a driving current for allowing the organic light emitting diode OLED to emit light based on the data signal DATA.

The storage capacitor CST may be connected between the first node N1 and the second node N2. In some example embodiments, the storage capacitor CST may store a voltage difference between a voltage of the gate of the driving transistor TD and a voltage of the second terminal of the driving transistor TD.

The organic light emitting diode OLED may be connected between the second node N2 and a line of the second power supply voltage ELVSS. An anode of the organic light emitting diode OLED may correspond to the second node N2. The organic light emitting diode OLED may emit light with luminance corresponding to the driving current generated by the driving transistor TD.

As described above, in the pixel 10 including the driving transistor TD implemented with the N-type MOS transistor, the first and second transistors T1 and T2 may be implemented with the P-type MOS transistors, and thus the swing widths of the scan signal SCAN(k) and the global signal GC may be decreased. Accordingly, the power consumption for outputting the scan signal SCAN(k) and the global signal GC may be reduced, and thus the power consumption of the display device 100 driven in the simultaneous emission driving method may be reduced.

Figure 4:
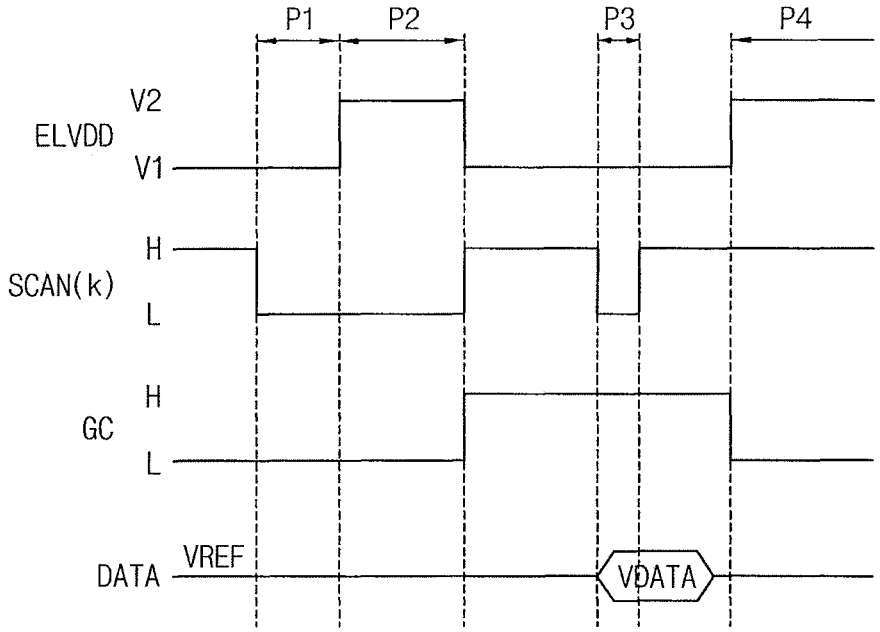
FIG. 4 illustrates a timing diagram for describing an example of an operation of a pixel of FIG. 3.

FIG. 4 is a timing diagram for describing an example of an operation of a pixel of FIG. 3. Referring to FIGS. 3 and 4, each frame may include an initialization period P1, a compensation period P2 after the initialization period P1, a writing period P3 after the compensation period P2, and a simultaneous emission period P4 after the writing period P3.

In a display device driven in a simultaneous emission driving method, a first power supply voltage ELVDD may swing a first voltage level V1 and a second voltage level V2 higher than the first voltage level V1. A second power supply voltage ELVSS may have a constant voltage level. For example, the second power supply voltage ELVSS may be a ground voltage. In some example embodiments, the first voltage level V1 may be higher than the voltage level of the second power supply voltage ELVSS (e.g., the ground voltage), and the second voltage level V2 may be higher than the voltage level of the second power supply voltage ELVSS. For example, the first voltage level V1 may be about −2.2 V, and the second voltage level V2 may be about 7 V.

In the initialization period P1, a first power supply voltage ELVDD may have the first voltage level V1, and a scan signal SCAN(k) and a global signal GC may have a turn-on level L (i.e., an active voltage level for a P-type MOS transistor or a low voltage level). Further, in the initialization period P1, a data signal DATA may include a reference voltage VREF for initialization, and the reference voltage VREF may be applied to a pixel 10 through a data line DLj. In the initialization period P1, a first transistor T1 may be turned on to transfer the reference voltage VREF to a first node N1, and a second transistor T2 may be turned on to transfer the first power supply voltage ELVDD having the first voltage level V1 to a second node N2. Thus, a gate voltage of a driving transistor TD (i.e., a voltage of the first node N1) may be initialized (or reset) to the reference voltage VREF, and an anode voltage of an organic light emitting diode OLED (i.e., a voltage of the second node N2) may be initialized (or reset) to the first voltage level V1 of the first power supply voltage ELVDD.

In the compensation period P2, the first power supply voltage ELVDD may have the second voltage level V2, and the first through n-th scan signals SCAN(1) through SCAN (n) and the global signal GC may maintain the turn-on level L. Further, in the compensation period P2, the data signal DATA may maintain the reference voltage VREF. In the compensation period P2, a threshold voltage compensation operation for the driving transistor TD may be performed. For example, in the compensation period P2, the gate voltage of the driving transistor TD may be maintained as the reference voltage VREF, a drain-source current of the driving transistor TD may flow into a storage capacitor CST, and thus the voltage of the second node N2 may become the reference voltage VREF minus a threshold voltage of the driving transistor TD, or "VREF-Vth". That is, the storage capacitor CST may store a voltage corresponding to the threshold voltage (Vth) of the driving transistor TD.

In the writing period P3, the first power supply voltage ELVDD may again have the first voltage level V1, the scan signal SCAN(k) may have the turn-on level L, and the global signal GC may have a turn-off level H. Further, the data signal DATA may include a data voltage VDATA corresponding to desired luminance. In the writing period P3, the first transistor T1 may be turned on, and the second transistor T2 may be turned off. Thus, in the writing period P3, the data voltage VDATA may be transferred to the first node N1, and the voltage of the second node N2 may become the data voltage VDATA minus the threshold voltage (Vth), or "VDATA-Vth".

In the simultaneous emission period P4, the first power supply voltage ELVDD may again have the second voltage level V2, the scan signal SCAN(k) may have the turn-off level H, and the global signal GC may have the turn-on level L. Accordingly, the second transistor T2 may be turned on, and the driving transistor TD may generate a driving current based on the data voltage VDATA. Further, because of the threshold voltage compensation operation, an amount of the driving current may be affected by the data voltage VDATA, but not affected by the threshold voltage (Vth). Thus, the organic light emitting diode OLED may emit light with luminance corresponding to the data voltage VDATA based on the driving current.

As described above, in the display device driven in the simultaneous emission driving method according to example embodiments, the pixel 10 may include the N-type MOS driving transistor TD and the P-type MOS switching transistors T1 and T2. As a result, the swing widths of the scan signal SCAN(k) and the global signal GC may be decreased, thereby reducing the power consumption.

Figure 5:
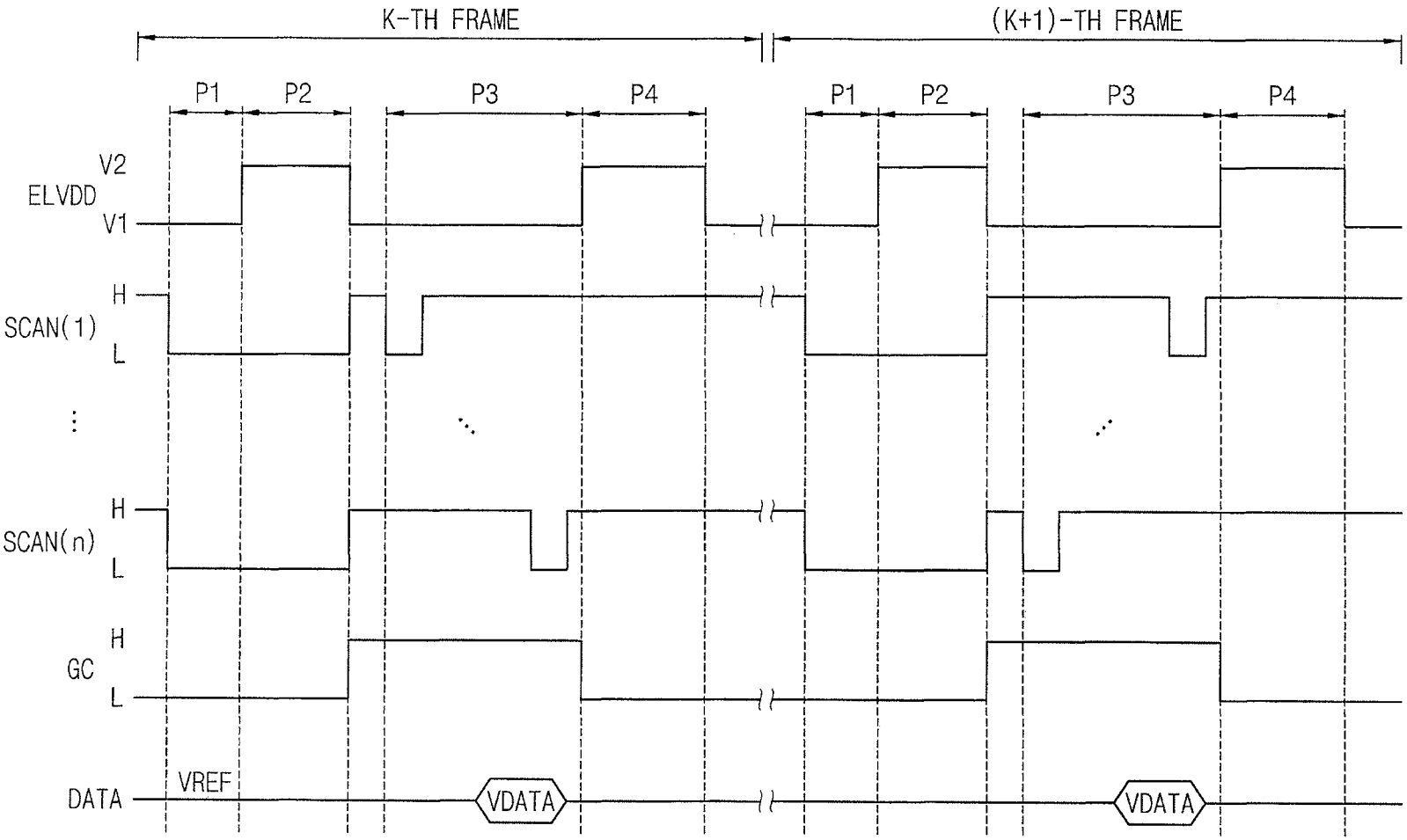
FIG. 5 illustrates a timing diagram for describing another example of an operation of a display device of FIG. 1.

FIG. 5 is a timing diagram for describing another example of an operation of a display device of FIG. 1. Referring to FIGS. 1 and 5, a display device 100 may invert, at every predetermined number of frames, an order of outputting a scan signal in a writing period P3.

Each frame of the display device 100 may include an initialization period P1, a compensation period P2 after the initialization period P1, a writing period P3 after the compensation period P2, and a simultaneous emission period P4 after the writing period P3. Operations in respective periods P1 through P4 are described above, and thus duplicated descriptions will be omitted. The display device 100 may include a pixel 10 illustrated in FIG. 3.

At each frame, an initialization operation in the initialization period P1 may be performed simultaneously for all the pixels 10. Further, a compensation operation in the compensation period P2 also may be performed simultaneously for all the pixels 10. However, a data writing operation in the writing period P3 may be sequentially performed on a row-by-row basis.

In a simultaneous emission driving method, a first row of the pixels 10 to which a scan signal (e.g., SCAN(1) in a K-th frame in FIG. 5) is first applied may have a relatively long wait period from a time point of the data writing operation to a start time point of the simultaneous emission period P4. This long wait period lead to a large current leakage, which may result in a mura defect.

To reduce the current leakage and the mura defect, the display device 100 may invert, at every predetermined number of frames, an order of outputting a scan signal in a writing period P3. Thus, if a row of the pixels 10 may have the relatively long wait period from the time point of the data writing operation to the start time point of the simultaneous emission period P4 at a first frame, the row of the pixels 10 may have a relatively short wait period at an adjacent second frame. In some example embodiments, as illustrated in FIG. 5, a panel driver 180 (or a scan driver 120) may sequentially output the scan signal SCAN(1) through SCAN(n) in a first order from a first scan line SL1 to an n-th scan line SLn at a K-th frame, and may sequentially output the scan signal SCAN(n) through SCAN(1) in a second order opposite to the first order from the n-th scan line SLn to the first scan line SL1 at a (K+1)-th frame. That is, in the writing period P3 of the K-th frame, a first scan signal SCAN(1) may first have a turn-on level L, second through (n−1)-th scan signals may sequentially have the turn-on level L, and an n-th scan signal SCAN(n) may last have the turn-on level L. On the contrary, in the writing period P3 of the (K+1)-th frame, the n-th scan signal SCAN(n) may first have the turn-on level L, (n−1)-th through second scan signals may sequentially have the turn-on level L, and the first scan signal SCAN(1) may last have the turn-on level L. In some example embodiments, the predetermined number of frames may be one frame, and the output order of the scan signal may be inverted at each frame. However, the predetermined number of frames may not be limited to one frame.

As described above, the output order of the scan signal may be periodically inverted at every predetermined number of frames, and thus the current leakage and the mura defect may be reduced.

Figure 6:
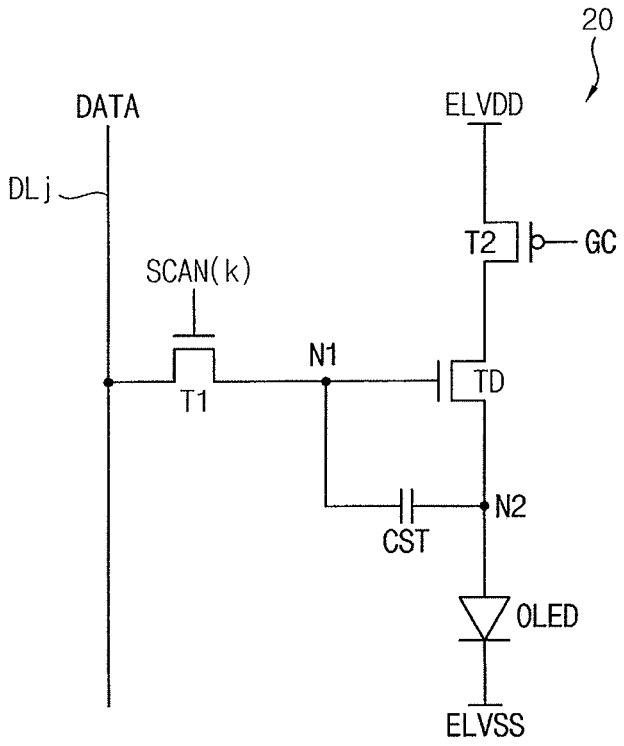
FIG. 6 illustrates a circuit diagram of a pixel according to example embodiments.
Figure 7:
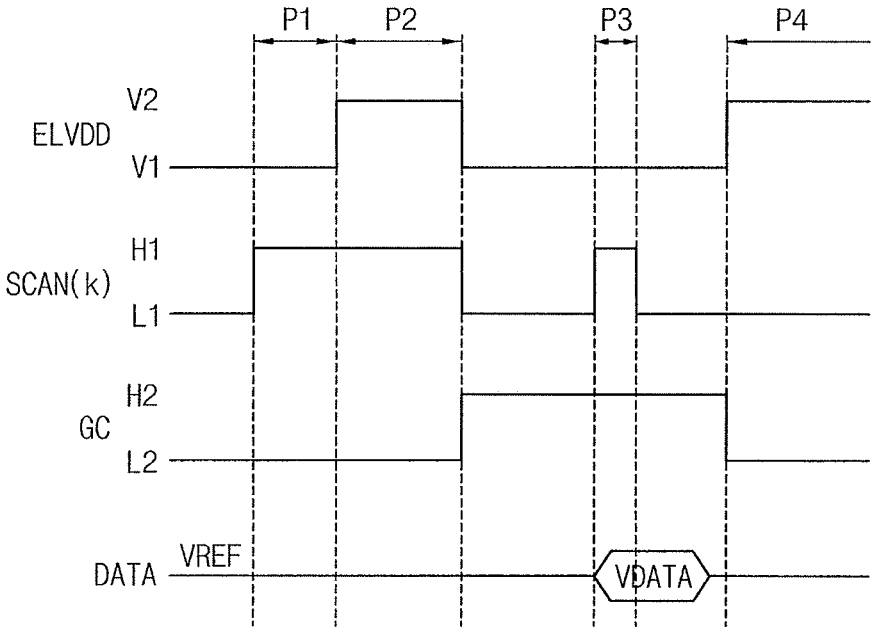
FIG. 7 illustrates a timing diagram for describing an example of an operation of a pixel of FIG. 6.

FIG. 6 is a circuit diagram illustrating a pixel according to example embodiments. FIG. 7 is a timing diagram for describing an example of an operation of a pixel of FIG. 6.

A pixel 20 illustrated in FIG. 6 may have a similar configuration and a similar operation to those of a pixel 10 illustrated in FIG. 6, except that a first transistor T1 may be implemented with an N-type MOS transistor. Duplicated descriptions will not be repeated.

Referring to FIGS. 6 and 7, the pixel 20 may include the first transistor T1, a second transistor T2, a driving transistor TD, an organic light emitting diode OLED and a storage capacitor CST. In some example embodiments, as illustrated in FIG. 6, the driving transistor TD and the first transistor T1 may be N-type MOS transistors, and the second transistor T2 may be a P-type MOS transistor.

The first transistor T1 may transfer a data signal DATA to a first node N1 (or a gate of the driving transistor TD) in response to a scan signal SCAN(k). Since the first transistor T1 is the N-type MOS transistor, a turn-on level of the scan signal SCAN(k) may be a high voltage level H1, and a turn-off level of the scan signal SCAN(k) may be a low voltage level L1.

The second transistor T2 may connect a line of a first power supply voltage ELVDD to the driving transistor TD in response to a global signal GC, and may transfer the first power supply voltage ELVDD to a first terminal of the driving transistor TD. Since the second transistor T2 is the P-type MOS transistor, a turn-on level of the global signal GC may be a low voltage level L2, and a turn-off level of the global signal GC may be a high voltage level H2.

The high voltage level H1 of the scan signal SCAN(k) may be different from the high voltage level H2 of the global signal GC. For example, the high voltage level H1 (or the turn-on level) of the scan signal SCAN(k) may be set to about 17 V, and the high voltage level H2 (or the turn-off level) of the global signal GC may be set to about 7V. Further, the low voltage level L1 of the scan signal SCAN(k) may be different from or substantially the same as the low voltage level L2 of the global signal GC.

In other words, a swing width of the global signal GC applied to the P-type MOS transistor may be less than a swing width of the scan signal SCAN(k) applied to the N-type MOS transistor. Thus, the swing width of the global signal GC may be decreased.

The driving transistor TD may generate a driving current for light emission of the organic light emitting diode OLED in response to the data signal DATA.

As illustrated in FIGS. 6 and 7, the first transistor T1 may be turned on in response to the scan signal SCAN(k) having the high voltage level H1. Operations in an initialization period P1, a compensation period P2, a writing period P3 and a simultaneous emission period P4 may be similar to operations described above with reference to FIGS. 3 and 4, and thus duplicated descriptions will be omitted.

As described above, the first transistor T1 for transferring the data signal DATA may be implemented with the N-type MOS transistor that is robust to a current leakage, and thus the current leakage through the first transistor T1 that may occur in a display device driven in a simultaneous emission driving method can be prevented. Accordingly, luminance deviation between upper and lower portions of a display panel and a mura defect caused by the current leakage may be prevented.

Figure 8:
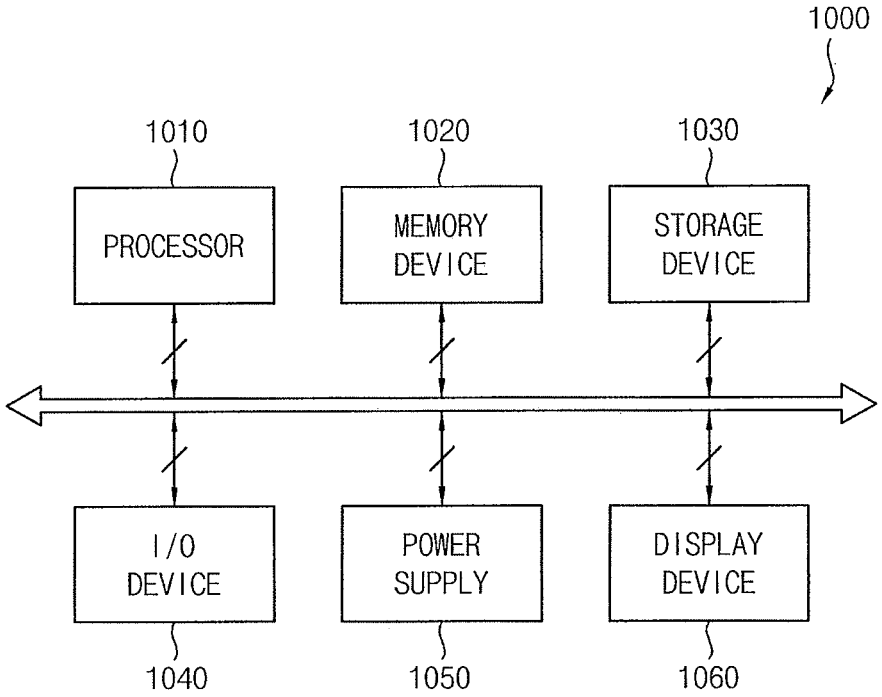
FIG. 8 illustrates a block diagram of an electronic device according to example embodiments.

FIG. 8 is a block diagram illustrating an electronic device according to example embodiments. Referring to FIG. 8, an electronic device 1000 may include a processor 1010, a memory device 1020, a storage device 1030, an input/output (I/O) device 1040, a power supply 1050, and a display device 1060. The display device 1060 may correspond to a display device 100 of FIG. 1.

The electronic device 1000 may further include a plurality of ports for communicating a video card, a sound card, a memory card, a universal serial bus (USB) device, other electronic devices, etc. In some example embodiments, the electronic device 1000 may be a wearable device, such as a smart watch, a head mounted display (HMD) electronic device, etc., a television (TV), a smartphone, a virtual reality (VR) device, a mobile phone, a video phone, a smart pad, a table computer, a car navigation device, a computer monitor, a laptop computer, etc.

The processor 1010 may perform various computing functions or tasks. In some example embodiments, processor 1010 may be an application processor (AP), a central processing unit (CPU), a graphics processing unit (GPU), a microprocessor, etc. The processor 1010 may be coupled to other components via an address bus, a control bus, a data bus, etc. Further, the processor 1010 may be coupled to an extended bus such as a peripheral component interconnection (PCI) bus.

The memory device 1020 may store data for operations of the electronic device 1000. For example, the memory device 1020 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile DRAM device, etc.

The storage device 1030 may be a solid state drive (SSD) device, a hard disk drive (HDD) device, a CD-ROM device, etc.

The I/O device 1040 may be an input device such as a keyboard, a keypad, a mouse device, a touchpad, a touchscreen, a remote controller, etc., and an output device such as a printer, a speaker, etc.

The power supply 1050 may provide power for operations of the electronic device 1000.

The display device 1060 may be coupled to other components via the buses or other communication links. In some example embodiments, the display device 1060 may be included in the I/O device 1040. The display device 1060 may include a display panel including a plurality of pixels, and a panel driver that drives all the pixels in a simultaneous emission driving method where each frame includes a simultaneous emission period in which all the pixels simultaneously emit light. The panel driver may include a scan driver, a global gate driver, a data driver, a power supply and a timing controller.

Each pixel may include a first transistor connected between a data line and a first node and receiving a scan signal at a gate of the first transistor, a second transistor that transfers a first power supply voltage having a first voltage level or a second voltage level higher than the first voltage level in response to a global signal, a driving transistor connected between the second transistor and a second node and having a gate connected to the first node, an organic light emitting diode connected between the second node and a line of a second power supply voltage having a voltage level higher than the first voltage level and lower than the second voltage level, and a storage capacitor connected between the first node and the second node. In some example embodiments, the driving transistor may be an N-type MOS transistor, and the second transistor may be a P-type transistor. An operation and a configuration of the display device 1060 are described above with reference to FIGS. 1 through 7, and duplicate descriptions will not be repeated.

As described above, a swing width of the scan signal and/or the global signal may be decreased, and power consumption of the display device 1060 and the electronic device 100 may be reduced.

Embodiments may be applied to any electronic device 1000 including the display device 1060. For example, embodiments may be applied to a HMD device, a TV, a digital TV, a 3D TV, a personal computer, a home appliance, a laptop computer, a tablet computer, a cellular phone, a smart phone, a personal digital assistant (PDA), a portable multimedia player (PMP), a digital camera, a music player, a portable game console, a navigation device, etc.

By way of summation and review, as described above, the display device using the simultaneous emission driving method and the pixel included in the display device according to example embodiments may include an NMOS driving transistor and at least one PMOS switching transistor, thereby reducing a swing width of the scan signal and/or the global signal. Accordingly, power consumption of the display device using the simultaneous emission driving method may be reduced. Further, an output order of the scan signal may be inverted at every predetermined number of frames, thereby preventing a current leakage that may be caused by the simultaneous emission driving method and a Mura defect due to the current leakage.

Further, in some example embodiments, the first transistor that transfers the data signal may be implemented with an N-type MOS transistor that is robust to the current leakage, and the second transistor that controls light emission may be implemented with a P-type MOS transistor. Thus, not only the current leakage through the first transistor which may be caused by the simultaneous emission driving method can be prevented, but also a swing width of the global signal applied to the second transistor may be reduced. Accordingly, luminance deviation between upper and lower portions of the display panel and the Mura defect caused by the current leakage may be prevented, and power consumption may be reduced.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A display device, comprising:

a display panel including a plurality of scan lines, a plurality of data lines, a common emission control line, and a plurality of pixels connected to the scan lines, the data lines and the common emission control line; and a panel driver to generate a scan signal sequentially provided to the scan lines, to generate data signals provided to the data lines, to generate a global signal provided to the common emission control line, and to provide a first power supply voltage and a second power supply voltage to the display panel, wherein each of the plurality of pixels includes:

a first transistor connected between one of the data lines and a first node, the first transistor receiving the scan signal at a gate of the first transistor;

a second transistor to transfer the first power supply voltage in response to the global signal, the first power supply voltage having a first voltage level or a second voltage level higher than the first voltage level;

a driving transistor connected between the second transistor and a second node, the driving transistor having a gate connected to the first node;

an organic light emitting diode connected between the second node and a line of the second power supply voltage, the second power supply voltage having a third voltage level higher than the first voltage level and lower than the second voltage level; and a storage capacitor connected between the first node and the second node, wherein the driving transistor is one of N-type or P-type transistor and the second transistor is another of N-type or P-type transistor, and wherein, in a writing period, the first power supply voltage has the first voltage level, the scan signal has a turn-on level, and the global signal has a turn-off level.

2. The display device as claimed in claim 1, wherein:

the driving transistor is an N-type metal oxide semiconductor (MOS) transistor, and the second transistor is a P-type MOS transistor.

3. The display device as claimed in claim 2, wherein each frame of the display device includes:

an initialization period in which a voltage of the first node and a voltage of the second node are initialized, a compensation period in which a threshold voltage of the driving transistor is compensated, the writing period in which the data signals are sequentially written to the pixels on a row-by-row basis, and a simultaneous emission period in which all the pixels simultaneously emit light based on the data signals.

4. The display device as claimed in claim 3, wherein the panel driver inverts, at every predetermined number of frames, an order of outputting the scan signal in the writing period.

5. The display device as claimed in claim 4, wherein the panel driver sequentially provides the scan signal in a first order from a first scan line to a last scan line in the writing period of a first frame, and sequentially provides the scan signal in a second order opposite to the first order from the last scan line to the first scan line in the writing period of a second frame.

6. The display device as claimed in claim 3, wherein, in the initialization period, the first power supply voltage has the first voltage level, and the scan signal and the global signal have a turn-on level.

7. The display device as claimed in claim 3, wherein, in the compensation period, the first power supply voltage has the second voltage level, and the scan signal and the global signal have a turn-on level.

8. The display device as claimed in claim 3, wherein, in the simultaneous emission period, the first power supply voltage has the second voltage level, the scan signal has a turn-off level, and the global signal has a turn-on level.

9. The display device as claimed in claim 3, wherein the panel driver provides a predetermined reference voltage to the data lines in the initialization period and the compensation period.

10. The display device as claimed in claim 3, wherein each of an initialization operation in the initialization period and a compensation operation in the compensation period is performed simultaneously to all the pixels.

11. The display device as claimed in claim 2, wherein the first transistor is a P-type MOS transistor.

12. The display device as claimed in claim 2, wherein the first transistor is an N-type MOS transistor.

13. The display device as claimed in claim 12, wherein:

a turn-on level of the scan signal is a high voltage level, and a turn-on level of the global signal is a low voltage level.

14. The display device as claimed in claim 13, wherein a swing width of the global signal is less than a swing width of the scan signal.

15. The display device as claimed in claim 14, wherein a voltage high level of the global signal is lower than the high voltage level of the scan signal.

16. A pixel, comprising:

a first transistor connected between a data line and a first node, the first transistor receiving a scan signal at a gate of the first transistor;

a second transistor configured to transfer a first power supply voltage in response to a global signal, the first power supply voltage having a first voltage level or a second voltage level higher than the first voltage level;

a driving transistor connected between the second transistor and a second node, the driving transistor having a gate connected to the first node;

an organic light emitting diode connected between the second node and a line of a second power supply voltage, the second power supply voltage having a voltage level higher than the first voltage level and lower than the second voltage level; and a storage capacitor connected between the first node and the second node, wherein the driving transistor is one of N-type or P-type transistor and the second transistor is another of N-type or P-type transistor, and wherein, in a writing period, the first power supply voltage has the first voltage level, the scan signal has a turn-on level, and the global signal has a turn-off level.

17. The pixel as claimed in claim 16, wherein:

the driving transistor is an N-type metal oxide semiconductor (MOS) transistor, and the first transistor and the second transistor are P-type MOS transistors.

18. The pixel as claimed in claim 17, wherein the driving transistor is implemented with one of an oxide thin film transistor (TFT), a low temperature poly-silicon (LTPS) TFT, and a low temperature polycrystalline oxide (LTPO) TFT.

19. The pixel as claimed in claim 16, wherein:

the driving transistor and the first transistor are N-type MOS transistors, and the second transistor is a P-type MOS transistor.

* * * * *